United States Patent [19]

Scott et al.

[11] Patent Number: 4,534,608

[45] Date of Patent: Aug. 13, 1985

[54] SHIELDED CONNECTOR SHELL FOR FLAT CABLE

[75] Inventors: Fred J. Scott, Sunnyvale; Gary W. Walker, Cupertino, both of Calif.

[73] Assignee: Sperry Corporation, New York, N.Y.

[21] Appl. No.: 612,224

[22] Filed: May 21, 1984

[51] Int. Cl.[3] ..... H01R 13/631; H01R 13/658

[52] U.S. Cl. ..... 339/91 R; 339/94 A; 339/107; 339/143 R; 339/DIG. 3

[58] Field of Search ..... 339/14 R, 14 L, 14 P, 339/17 F, 91 R, 94 R, 94 A, 94 M, 103 M, 107, 141, 143 R, 176 MF, DIG. 3

[56] References Cited

U.S. PATENT DOCUMENTS 4,398,780 8/1983 Novotny et al. ..... 339/143 R

*Primary Examiner*—Neil Abrams

*Attorney, Agent, or Firm*—Thomas H. Olson; John B. Sowell; Marshall M. Truex

[57] ABSTRACT

A shell for a connector for flat shielded cable. The shell is formed of conductive material and is constructed so as physically and electrically to contact the shield so that grounding the shell will ground the shield. The shell also includes portions to grip firmly the cable so as to relieve strain from the cable-connector connection. Finally the shell defines a cavity for the connector; the cavity has one or more irregularities corresponding to mirror image irregularities in the connector cavity to assure proper positioning of the connector within the shell cavity. Associated with the receptacle adapted to receive the connector are two toggle latches; the shell is provided with external hooks adapted to cooperate with the toggle latches so as to achieve firm connection between the connector and the receptacle as well as connection of the shell to ground.

7 Claims, 13 Drawing Figures

SHIELDED CONNECTOR SHELL FOR FLAT CABLE

BACKGROUND OF THE INVENTION

1. Field of the Invention

This invention relates to a shell for a multiconductor, flat cable and more particularly to a shell that is constructed and arranged to prevent leakage of RF energy such as would cause electromagnetic interference (EMI).

2. Description of the Prior Art

With the proliferation of computer equipment and the increased frequencies or pulse rates employed in such equipment, the problems arising from electromagnetic interference (EMI) have become such that the FCC and other similar authorities have imposed increasingly stringent shielding requirements. Flat multiconductor cables encased in a conductive mesh have significantly reduced EMI. At the ends or terminations of such cables, however, solid ground connection to the shield is difficult, and is exacerbated in those cases where it may be necessary to disconnect and reconnect the flat cable for maintenance, testing or other purposes. A structure for affording connection to a shield in flat cable is shown in U.S. Pat. No. 4,300,017.

SUMMARY OF THE INVENTION

In accordance with the present invention there is a connector shell formed of two complemental matable halves. The halves are formed of electrically conductive material and in combination define a central passage adapted to perform several salutary functions. The central passage defines a cavity for housing a conventional flat cable connector. The central passage also has means for gripping the flat cable to relieve strain on the junction between the cable conductors and the connector. Also the central passage includes means for effecting firm electrical and physical contact with the cable shield without jeopardizing the integrity of the conductors or the insulation covering the conductors. Finally a shell embodying the present invention has exterior hooks which in combination with toggle latches adjacent the receptacle with which the cable connector is engaged assure both physical and electrical connection between the shell and ground. When the shell is grounded, the shield is grounded and EMI is virtually eliminated.

Because a shell embodying the invention is formed of two matable parts, both initial assembly and such disassembly as might be required for maintenance, are greatly facilitated. Moreover the matable members are provided with cooperating bosses and depressions which assure both that the two members are assembled correctly and that when assembled correctly they will remain in proper juxtaposition.

The foregoing, together with other objects, features and advantages of the invention, will be more apparent after referring to the following specification and the accompanying drawings.

DESCRIPTION OF A PREFERRED EMBODIMENT

Figure 12:
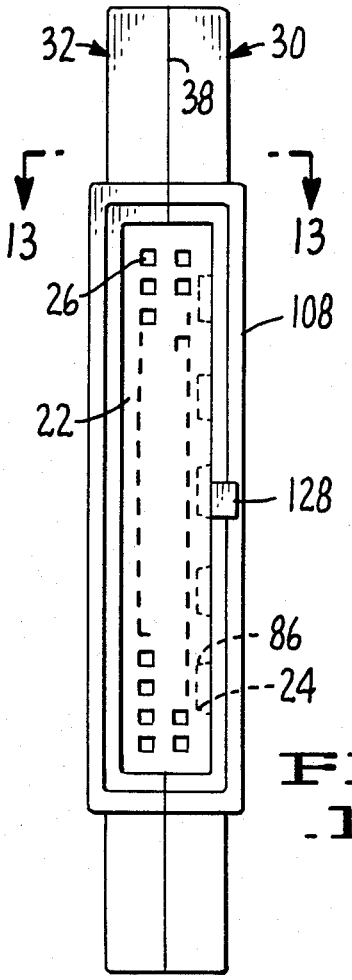
FIG. 12 is an end view of the flat cable connector in place in a shell according to the invention.
Figure 13:
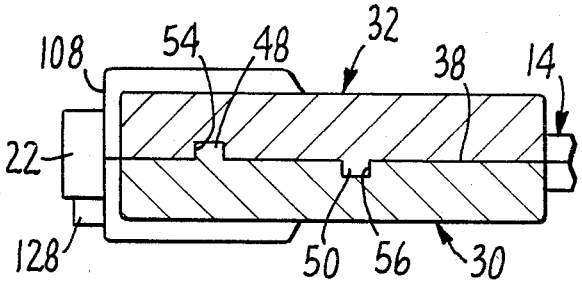
FIG. 13 is a cross sectional view taken substantially along line 13—13 of FIG. 12.

Referring more particularly to the drawings, reference numeral 12 generally indicates a connector shell constructed in accordance with the invention. Connector shell 12 is mounted at the end of a conventional flat shielded multiconductor cable 14. Cable 14 is a staple article of commerce and includes a flat array 16 of individually insulated conductors, a forty conductor cable being typical. Circumscribing the exterior of array 16 is a woven wire shield 18 which is sufficiently flexible to avoid interference with placement of the cable in any desired position and, when connected to ground, returns spurious emissions or EMI from the conductors in array 16 to ground. Surrounding shield 18 is an outer insulative sheath 20 which provides strength and integrity to the flat cable and maintains shield 18 in circumscribing relation to array 16. The conductors in array 16 are terminated by a conventional connector 22. Connector 22 is a commercially available item, the distributed by the 3M Company. Connector 22 has one or more indentations 24 on its side surface and as seen in FIG. 12 has a plurality of connector sockets 26, one for each of the conductors in cable array 16. A complemental receptacle 27 has a plurality of connector pins 28 which are disposed in a pattern equivalent to the pattern of connector sockets 26. The receptacle containing pins 28 is typically mounted on the frame or chassis of a piece of electronic or computer apparatus or the like.

Figure 6:
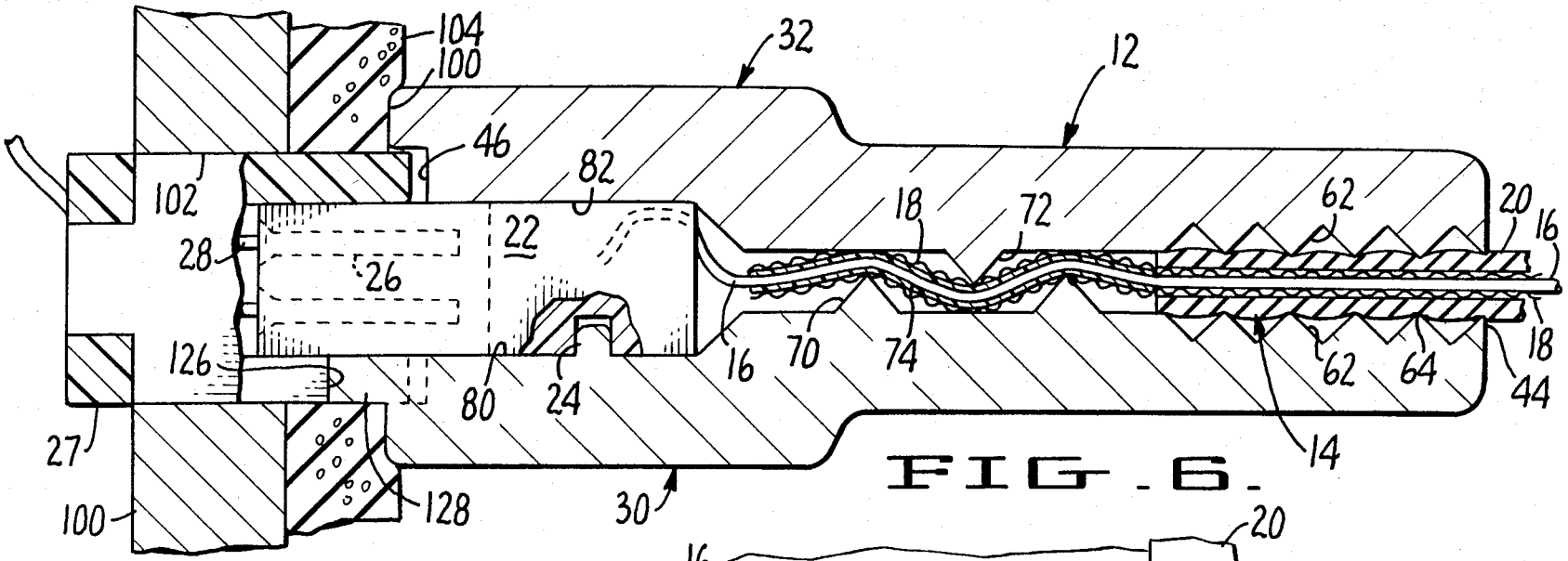
FIG. 6 is a side view in cross section of a shell in accordance with the invention engaged with a receptacle.
Figure 8:
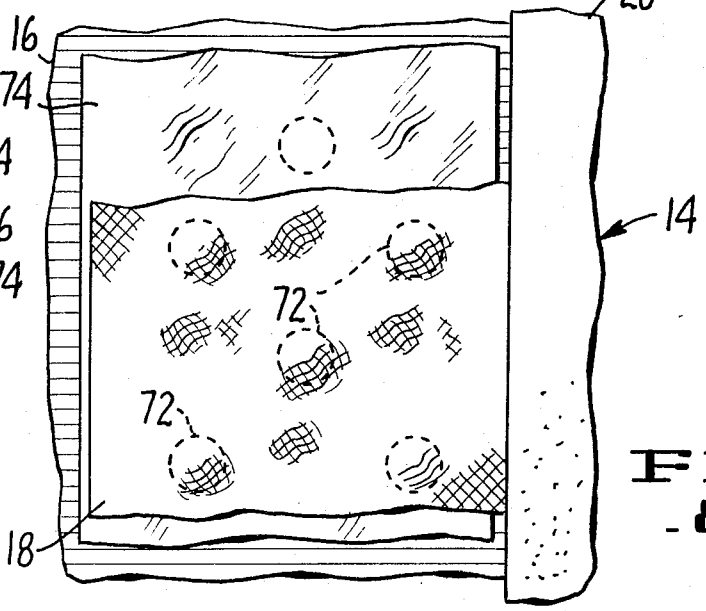
FIG. 8 is a view taken substantially on the center line of the passage through the connector shell projected from FIG. 6 and showing the collocation of conical members for contacting the shield in the shielded flat cable.

Connector shell 12 is formed by two matable halves 30 and 32. Shell half 30 has an internal surface 34 and shell half 32 has an internal surface 36. The inner surfaces in the embodiment shown in the drawings are planar so that the two halves when in assembled condition mate along a parting plane 38. Shell halves 30 and 32 are internally excised to form a central passage through the shell when the halves are mated along parting plane 38, shell half 30 defining an excision 40 and shell half 32 defining an excision 42 which coact to form the passage. Referring to FIG. 6, the passage has a cable end 44 and a connector end 46.

In order to facilitate assembly of the device and to assure correct alignment between the two shell halves, shell half 30 has protruding from the internal surface 34 thereof a pair of cylindrical bosses 48, and internal surface 36 of shell half 32 has a cylindrical boss 50 extending therefrom. Surface 32 also defines depressions 54 which are dimensioned and positioned to receive bosses 48 therein. Internal surface 34 of shell half 30 is formed with a similar depression 56 which is positioned and dimensioned to cooperate with boss 50 on shell half 32. The bosses and their cooperating depressions assure both that the two shell halves can be joined in only one relative orientation and that once so joined there can be no relative movement between the two halves. Each of the halves is provided with aligned through bores such as indicated at 58 through which suitable fasteners such as rivets 60 are installed to retain the two halves in an assembled condition.

Figure 5:
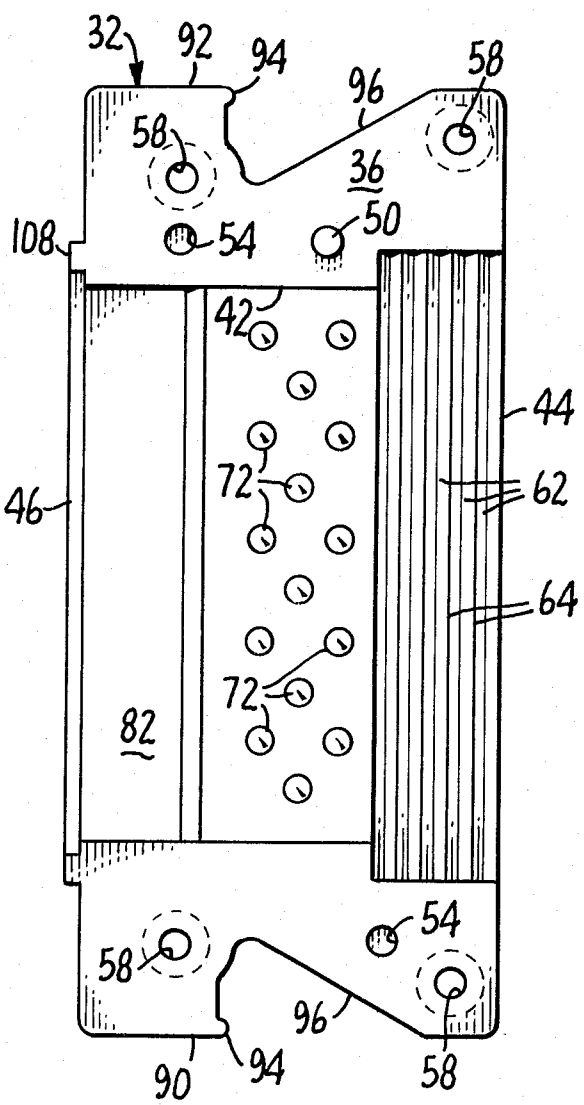
FIG. 5 is an interior view of the other of the members taken substantially along line 5—5 of FIG. 3.
Figure 3:
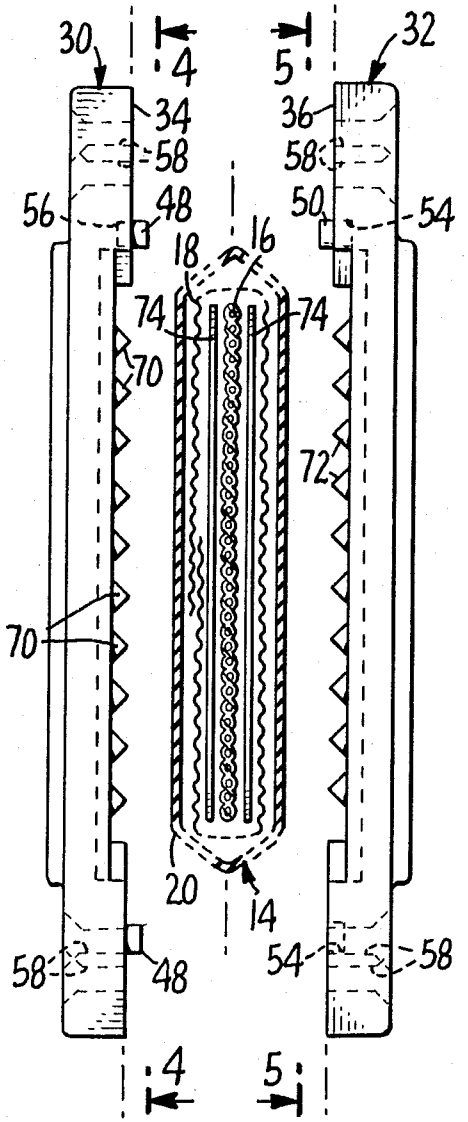
FIG. 3 is an exploded end view in cross section showing the two matable members and a flat shielded cable in cross sectional end view.
Figure 4:
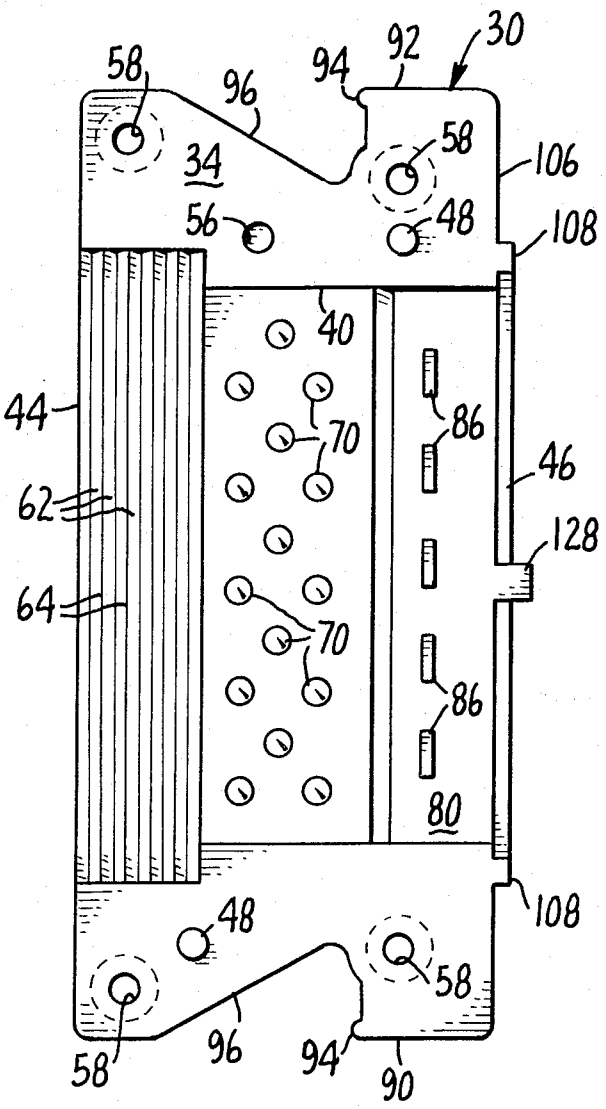
FIG. 4 is an interior view of one of the members taken substantially along line 4—4 of FIG. 3.
Figure 7:
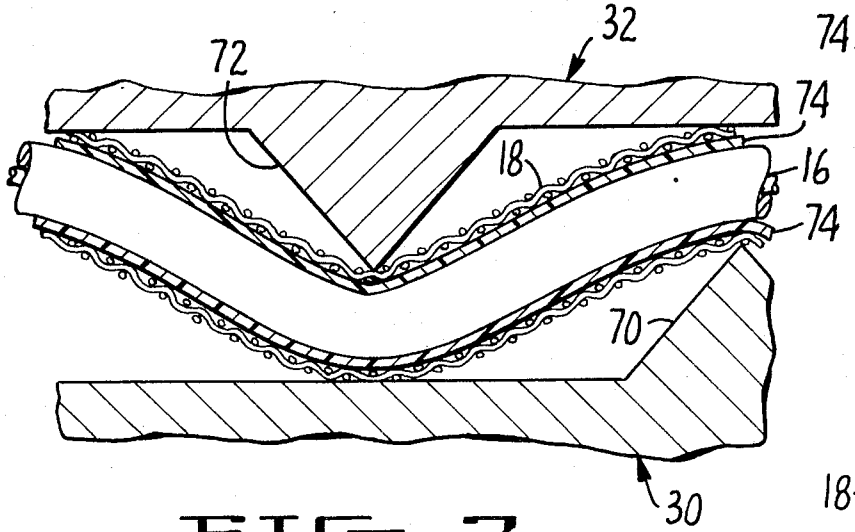
FIG. 7 is an enlarged view of a portion of FIG. 6 showing in greater detail the engagement between the shell and the cable shield.

Adjacent cable end 44 the passage defines strain relief means which are constituted by a plurality of transversely extending ribs or serrations 62. The portions of ribs 62 that confront the passage define relatively sharp crest edges 64 so as to compressively deform sheath 20 of the flat cable. As can be seen in FIG. 6 the angle between the planes that form crest edges 64 is approximately 90 degrees, an angle that is sufficient to compressively deform the sheath without puncturing the sheath or damaging the conductors in array 16. Crest edges 64 on respective halves 30 and 32 are transversely aligned and are spaced apart by a distance such as to slightly deform sheath 20 without damaging shield 18 or the conductors and insulation in conductor array 16. Inward of the strain relief portion of the passage formed by ribs 62, the passage is provided with means for effecting electrical and physical contact with cable shield 18. Referring to FIGS. 3–5, shell half 30 defines an array of inward extending conical projections 70 and shell half 32 defines an array of inwardly extending conical projections 72. A comparison of FIGS. 4 and 5 illustrates that the individual conical projections in the respective arrays are offset with one another so that when the shell halves are assembled along parting plane 38, each projection 70 resides between adjacent projections 72 and vice versa. Thus when the two halves are assembled in mated relation on parting plane 38 the conical projections deform shield 18 and conductor array 16 and establish firm and intimate electric contact with the shield. Referring to FIGS. 6 and 7, the coaction of the conical projections 70 and 72 deforms the shield and the array into a serpentine configuration so that contact with the shield is established from both sides. It will be appreciated that a view taken transversely of that of FIG. 6 would show an equivalent serpentine configuration of the shield and array. Because shield 18 is typically of loosely woven construction and because conical projections 70 and 72 terminate in a relatively sharp point, it is desirable to install between the shield and conductor array 16 a protective shield 74. The protective shield is preferably constructed of material that is both flexible but has sufficient strength to avoid being punctured by conical projections 70 and 72, Mylar being suitable for this purpose. The transverse extent of protective shield 74 is substantially equivalent to the transverse extent of array 16 and the longitudinal extent is approximately equal to the longitudinal extent of the region occupied by conical projections 70 and 72.

Spaced along the passage from the shield contacting region toward connector end 46 of the passage shell half 30 is formed with an excision 80 and shell half 32 is formed with a similar excision 82. Excisions 80 and 82 cooperate, when the two halves are assembled on parting plane 38 to form a parallelepiped cavity sized to house and retain connector 22 therein. Projecting into the cavity from the bottom of excision 80 is one or more protruding keys 86 which are engageable with indentations 24 so as to position connector 22 within the cavity in correct orientation or polarization. In the specific embodiment shown in the drawings there are multiple indentations 24 and multiple projecting keys 86. The cavity is so dimensioned with respect to the exterior dimensions of connector 22 that when the two shell halves are assembled on parting plane 38, the connector is firmly retained within the shell with connector sockets 26 accessible from the connector end of the shell as shown most clearly in FIG. 12.

The exterior of connector 12 is configured to define transversely opposite hooks 90 and 92. Because the hooks are of identical configuration, a description of one will suffice for a description of both. At its outer extremity the hook has a rearward protruding rib 94. The hook does not protrude beyond the main dimension of connector shell 12 and the hook is accessible, because of the presence of a relieved portion bounded in part by an inward converging surface 96. Thus the hook is accessible without unnecessarily enlarging shell 12. In addition surfaces 96 on either side of the shell facilitate manipulation of the shell during engagement and disengagement of the connector with the receptacle.

Receptacle 27 is supported in mounting body 100. In the specific embodiment shown in the drawings mounting body is adapted to support two receptacles 27, such number being exemplary, not limiting. Mounting body 100 is secured to a panel 101 which is typically a part of a cabinet or chassis containing electronic equipment and is typically accessible from exterior of the equipment. Mounting body 100 is formed with a fenestration for each cable connector, the boundary of one fenestration being indicated at 102 in FIGS. 9 and 10. Receptacle 27 is mounted in mounting body 100 and projects through fenestration 102 so as to be accessible for engagement by connector 22. Surrounding the protruding portion of receptacle 27 is a conductive gasket 104. The gasket 104 is constructed of commercially available sponge like material having conductive wires embedded therein, an exemplary material being sold under the trademark Elastofoam by the Technit Company of Santa Barbara, Calif. The material is resiliently compressible so that when connector 22 within shell 12 is engaged with receptacle 27, a continuous electrically conductive path is established that totally surrounds connector 22 and receptacle 27.

To facilitate establishment of such continuous conductive path around the connector, the shell has extending from its forward planar surface 106 a rib 108 which has portions in both connector shell halves 30 and 32 so as totally to circumscribe the connector opening. The width of rib 108 is sufficient to provide adequate strength and sufficient area of electrical contact with gasket 104 but is sufficiently narrow that it can, without application of undue force, deform or compress a portion of gasket 104 to assure good electrical contact between the gasket and the connector shell. Deformation of the gasket is indicated in FIG. 6 at 110.

Figure 1:
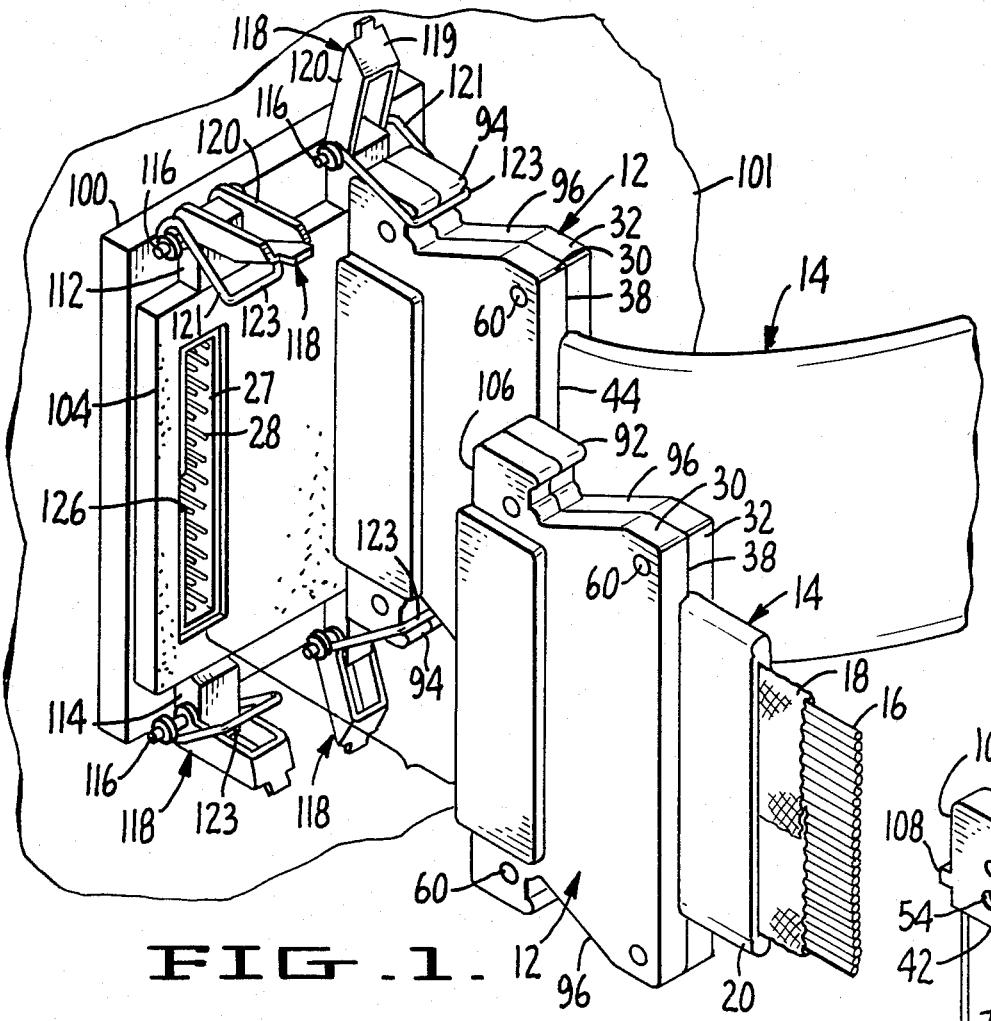
FIG. 1 is a perspective view of a flat cable connector shell according to the invention shown in cooperation with a receptacle with which it is engaged during operation of the system of which the cable and connector are a part.
Figure 9:
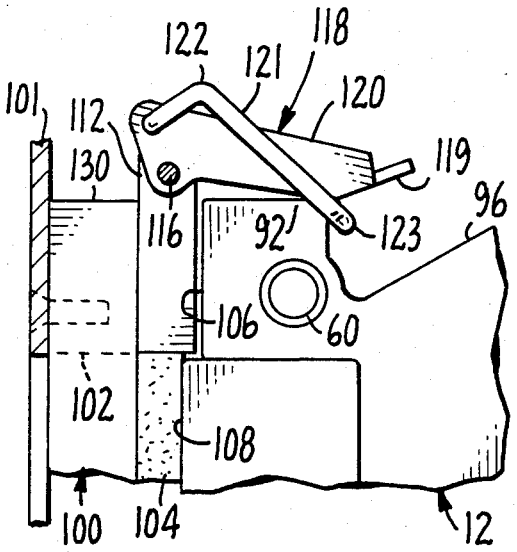
FIG. 9 is a fragmentary side view of a shell in accordance with the invention connected to a receptacle and showing a latch in a released position.

Fixed to mounting body 100 at opposite longitudinal extremities of fenestration 102 are latch mounting blocks 112 and 114. The latch mounting blocks can be integral with mounting body 100 or can be affixed thereto by suitable fasteners. The inner edge surfaces of the mounting blocks are spaced away from receptacle 27 so the surface of mounting body 100 forms an uninterrupted planar marginal surface that circumscribes the receptacle. Gasket 104 is dimensioned to fit snugly between the mounting blocks, thereby to insure that the gasket is correctly positioned. At a portion of each mounting block 112, 114 there is formed a bore oriented parallel to the front surface of mounting body 100 and transverse to the longitudinal extent of receptacle 27. Disposed within the bore is a pivot shaft 116 which supports for pivotal movement a toggle lever 118. Toggle lever 118, as seen most clearly in FIG. 1, has a cross web 119 from which side plates 120 extend. At sites remote from cross web 119 the side plates are bored to cooperate with shaft 116 so to permit pivotal movement of the toggle lever. The side walls also have aligned bores remote from the pivot axis formed by shaft 116 to receive the ends of a bail 121. As seen in FIG. 9 bail 121 has a knee 122 so that toggle number 118 can move to an over-the-center position (FIG. 10) and apply force to bail crossbar 123 which engages hook portion 94 thereby to draw shell 12 toward the receptacle. Consequently, good electrical contact is established between connector openings 26 and connector pins 28 as well as between rib 108 and gasket 104.

Receptacle 27 has a cutout 126 in its side wall (see FIG. 1) which is a typical expedient for assuring correct polarization between the receptacle and the connector, such as connector 22, that is adapted to engage with the receptacle. In accordance with the present invention, shell half 30 is provided with a protruding key 128 which is sized and positioned to cooperate with cutout 126 to assure correct polarization of the connector and the receptacle. As seen in FIG. 12 key 128 does not interfere with contact sockets 26 in connector 22 but is positioned immediately adjacent the opening at connector end 46 of the shell. The width of key 128 is such as to leave a marginal portion of rib 108 unobstructed, thereby permitting continuous contact between the rib and gasket 104.

Figure 2:
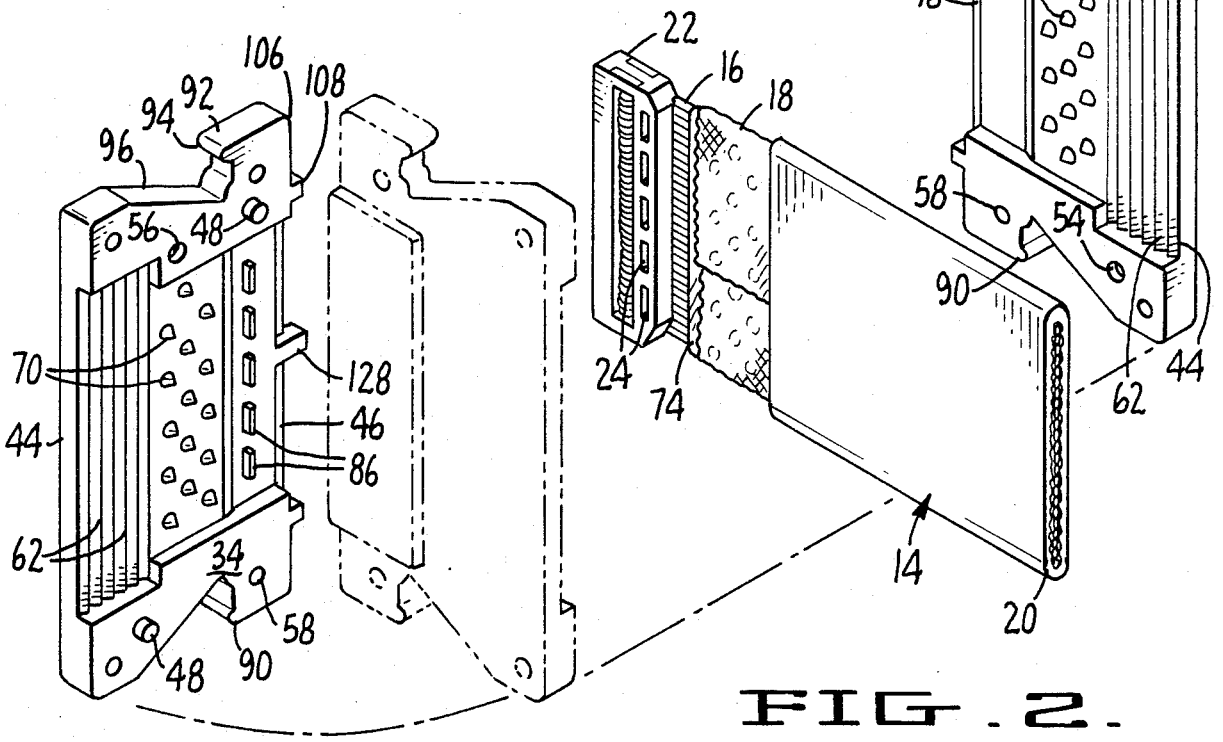
FIG. 2 is an exploded view of a shell according to the invention and a flat cable connector with which the shell is adapted to cooperate.

In using a connector shell in accordance with the present invention, the end of flat cable 14 is prepared as shown in FIG. 2. First, a portion of outer sheath 20 is cut away. Shield 18 requires an exposed portion approximating the extent of the arrays formed by conical projections 70 and 72. The ends of the conductors in array 16 are engaged with connector 22 in a manner determined by the specific connector employed. Because the construction of connector 22 and the manner of terminating the wires in array 16 to it form no part of the invention, no further description of attachment of the connector to the conductors is given. Then protective shields 74 are installed one on either side of conductor array 16 between the outer surface of the array and the innner surface of conductive shield 18.

The cable and connector assembled as described next above is then introduced into one of the shell halves, preferably shell half 30 which has projections 86. Connector 22 is manipulated until projections 86 nest into and engage indentations 24 in the connector. With the exposed portion of shield 18 oriented in alignment with the array of conical projections 70 and the inner end of sheath 14 in alignment with ribs 62, shell half 32 is moved into position onto shell half 30 and the cable temporarily supported therein. The two shell halves are then pressed toward one another and manipulated so that boss 50 aligns with depression 56 and bosses 48 are aligned with respective depressions 54. When such alignment is achieved the two members can be forced together and fixed by rivets 60 installed through aligned pairs of holes 58. When the two shell halves are brought together with sufficient force to establish contact between the two halves along parting plane 38, conical projections move into intimate physical and electrical contact with shield 18 and ribs 62 partially deform sheath 20. Thus installation of the shield can be effected rapidly and conveniently.

Figure 10:
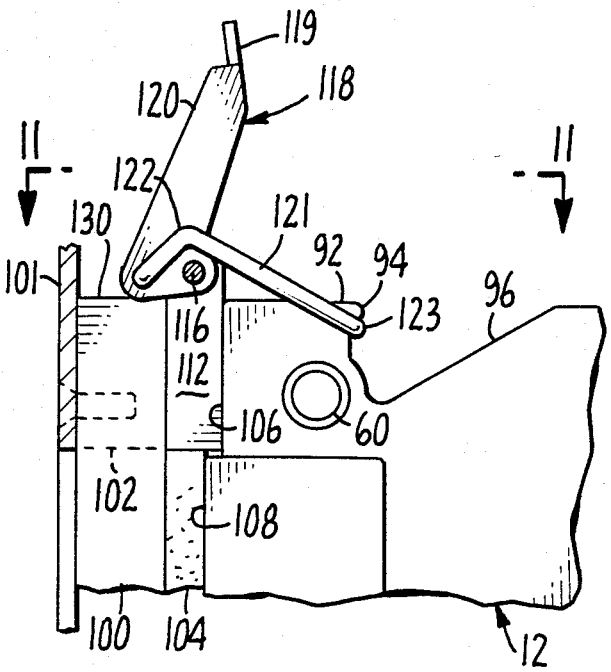
FIG. 10 is a view similar to FIG. 9 showing the latch in an engaged position.
Figure 11:
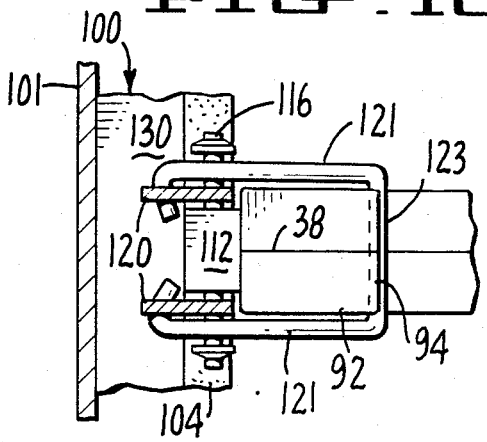
FIG. 11 is top view of the latch taken substantially along line 11—11 of FIG. 10.

When it is desired to engage connector 22 with receptacle 27, shell 12 is moved toward mounting body 100 with key 128 positioned for alignment with slot 126. When the connector is inserted into the receptacle, bails 121 are engaged with respective hooks 90 and 92 and toggle levers 118 are pivoted around shaft 116 toward panel 101. When the toggle levers reach an over center position as seen in FIG. 10, connector 22 is firmly engaged with receptacle 27 and gasket 104 is compressed by rib 108 so as to establish shell 12 and shield 18 at ground potential. It will be noted in FIG. 10 that the location of the pivot axis formed by shaft 116 and the geometry of side plates 120 of the toggle lever are established with respect to the upper surface 130 of mounting body 100 so that the toggle lever is maintained in the over-the-center position at which it imparts a constant inward force on connector shell 12.

Should it become necessary to disconnect connector 22 from receptacle 20, the toggle levers are pivoted outward (in a clockwise direction as seen in FIG. 10) until bails 121 can be pivoted free of hooks 92 and 94. The presence of surface 96 forms a convenient hand grip so that the shell and connector 22 disposed therein can be readily disconnected from receptacle 27.

Thus it will be seen that the present invention provides a connector shell for flat cables that is convenient to install and to use and that virtually eliminates EMI adjacent the connector and its junction with the receptacle. The presence of toggle levers 118 and cooperating hooks 90 and 92 on connector shell 12 assures that solid connection between connector 22 and receptacle 27 as well as connection between the shell and ground is maintained under all circumstances. The construction of the parts of the shell that bound the central passage assures correct positioning of the connector, establishes ground connection to the cable shield and eliminates strain on the junction between the cable and the connector.

Although one embodiment of the invention has been shown and described, it will be obvious that other adaptations and modifications can be made without departing from the true spirit and scope of the invention.

What is claimed is:

1. A connector shell for a shielded flat cable termination comprising first and second complemental matable members formed of rigid electrically conductive material, means for joining said members in assembled relation on a parting plane, said members defining a cable end and a connector end opposite from said cable end, said members forming a continuous passage through said connector shell between said ends, said passage adjacent said cable end defining strain relief means, said strain relief means including a plurality of ribs oriented transversely of said passage projecting inward of each said member, respective said ribs being transversely aligned and having confronting edge lines confronting each other in spaced apart relation by a distance such as to grip flat shielded cable therebetween, said connector having inward of said strain relief means a region constituting shield contacting means, said shield contacting means including first and second arrays of spaced apart generally conical protuberances extending into said passages from respective said members, the inner extremities of said conical protuberances extending beyond said parting plane and said arrays being offset from one another so that the protuberances in one array reside in the spaces between protuberances in the other array thereby to establish firm electrical continuity between said members and the shield in said cable, said shell also defining adjacent said connector end a cavity in said passage for a flat cable connector, said cavity being substantially symmetrical of said parting plane and being sized to receive a connector therein so that the contacts in the connector are accessible through said connector end.

2. A connector shell in accordance with claim 1 wherein said shell defines at said connector end a substantially planar surface oriented transversely of said passage, a substantially continuous rib projecting from said planar surface and circumscribing said connector end, said rib defining a planar surface extending substantially transversely of said passage and adapted for substantially continuous contact with a conductive gasket surrounding a receptacle with which said connector connects.

3. A connector shell in accordance with claim 1 wherein the connector has a surface defining at least one irregularity, said shell cavity having a mirror image irregularity for engaging said connector irregularity and securing said connector substantially immovably within said shell.

4. A connector shell in accordance with claim 1 wherein said shell defines exteriorly thereof first and second transversely opposite hook portions, and having in combination a receptacle for effecting connection with said connector and first and second toggle latches fixed at opposite extremities of said receptacle, each said toggle latch having a bail for removably engaging a respective said hook portion.

5. A connector shell in accordance with claim 4 wherein said receptacle has a polarizing excision at a marginal portion thereof and wherein said one of said shell members includes a protruding key engageable with said excision to effect correct polarization of the connector in said connector shell and said receptacle.

6. A connector shell in accordance with claim 4 including a mounting body for supporting at least one receptacle, said mounting body defining a substantially planar conductive surface circumscribing said receptacle, first and second mounting blocks rigid with said mounting body for supporting respective said toggle latches, said mounting blocks protruding from said planar surface and being spaced from said receptacle to define an uninterrupted margin circumscribing said receptacle, said mounting blocks defining respective side surfaces perpendicular to said planar surface and parallelly confronting one another on opposite sides of said receptacle, a conductive gasket dimensioned to reside between said side surfaces in contact with said planar surface, said gasket defining an opening for affording access to said receptacle.

7. A connector shell in accordance with claim 6 wherein said mounting body defines first and second surface portions substantially perpendicular to said planar surface and adjacent respective said mounting blocks, said surface portions cooperating with said toggle latches for limiting movement thereof to an over-the-center position to retain said connector shell in contact with said gasket.

* * * * *